US010900484B2

(12) United States Patent
Nishida

(10) Patent No.: US 10,900,484 B2
(45) Date of Patent: Jan. 26, 2021

(54) VARIABLE OIL PUMP HAVING ADJUSTMENT RING CONTAINING GUIDE PORTION WITH FLAT SURFACE

(71) Applicant: AISIN SEIKI KABUSHIKI KAISHA, Kariya (JP)

(72) Inventor: Yuki Nishida, Anjo (JP)

(73) Assignee: AISIN SEIKI KABUSHIKI KAISHA, Kariya (JP)

( * ) Notice: Subject to any disclaimer, the term of this patent is extended or adjusted under 35 U.S.C. 154(b) by 327 days.

(21) Appl. No.: 15/756,161

(22) PCT Filed: Aug. 19, 2016

(86) PCT No.: PCT/JP2016/074280
§ 371 (c)(1),
(2) Date: Feb. 28, 2018

(87) PCT Pub. No.: WO2017/051646
PCT Pub. Date: Mar. 30, 2017

(65) Prior Publication Data

US 2018/0245587 A1 Aug. 30, 2018

(30) Foreign Application Priority Data

Sep. 24, 2015 (JP) ..... 2015-186539

(51) Int. Cl.
*F04C 14/22* (2006.01)
*F04C 15/00* (2006.01)
(Continued)

(52) U.S. Cl.
CPC ..... *F04C 14/226* (2013.01); *F01C 21/0863* (2013.01); *F01M 1/16* (2013.01);
(Continued)

(58) Field of Classification Search
CPC ..... F01C 21/0863; F01M 1/16; F04C 14/226; F04C 2210/206; F04C 2270/185;
(Continued)

(56) References Cited

U.S. PATENT DOCUMENTS

2011/0014078 A1* 1/2011 Ono ..... F04C 2/102 418/166
2015/0354564 A1* 12/2015 Takahashi ..... F04C 13/002 418/19
2017/0241416 A1 8/2017 Yamamoto et al.

FOREIGN PATENT DOCUMENTS

JP 2014-159761 A 9/2014

OTHER PUBLICATIONS

U.S. Appl. No. 15/756,227, filed Feb. 28, 2018, Atsuo Isoda.
(Continued)

*Primary Examiner* — Patrick Hamo
*Assistant Examiner* — Paul W Thiede
(74) *Attorney, Agent, or Firm* — Buchanan Ingersoll & Rooney PC

(57) ABSTRACT

A variable oil pump includes a pump housing, an oil pump rotor housed in the pump housing and rotationally driven, an adjustment member housed in the pump housing and adjusting an oil discharge amount from the oil pump rotor by being displaced due to a drive force while rotatably holding the oil pump rotor from an outer peripheral side, and a guide portion including a groove provided in the adjustment member and a pin provided on the pump housing and engaging with the groove. The guide portion guides relative displacement of the adjustment member with respect to the pump housing by engaging the groove and the pin with each other, and an inner surface of the groove and an outer surface of the pin come into line contact with each other along a
(Continued)

direction in which the pin extends at an initial position where the adjustment member starts its displacement.

4 Claims, 4 Drawing Sheets

(51) Int. Cl.
*F01C 21/08* (2006.01)
*F01M 1/16* (2006.01)
*F04C 2/10* (2006.01)

(52) U.S. Cl.
CPC ..... *F04C 2/10* (2013.01); *F04C 2/102* (2013.01); *F04C 2210/206* (2013.01); *F04C 2270/185* (2013.01)

(58) Field of Classification Search
CPC ..... F04C 2/10; F04C 2/102; F04C 15/0026; F04C 14/18; F04C 14/223; F04C 2240/30; F04C 2240/10
USPC ..... 418/19, 16, 22, 24, 26–27, 29–31, 166, 418/171
See application file for complete search history.

(56) References Cited

OTHER PUBLICATIONS

International Search Report (PCT/ISA/210) dated Nov. 15, 2016, by the Japanese Patent Office as the International Searching Authority for International Application No. PCT/JP2016/074280.
Written Opinion (PCT/ISA/237) dated Nov. 15, 2016, by the Japanese Patent Office as the International Searching Authority for International Application No. PCT/JP2016/074280.
International Search Report (PCT/ISA/210) dated Nov. 15, 2016, by the Japanese Patent Office as the International Searching Authority for International Application No. PCT/JP2016/074277.
Written Opinion (PCT/ISA/237) dated Nov. 15, 2016, by the Japanese Patent Office as the International Searching Authority for International Application No. PCT/JP2016/074277.

* cited by examiner

VARIABLE OIL PUMP HAVING ADJUSTMENT RING CONTAINING GUIDE PORTION WITH FLAT SURFACE

TECHNICAL FIELD

The present invention relates to a variable oil pump.

BACKGROUND ART

In general, a variable oil pump including a pump housing and an adjustment member that adjusts the amount of oil discharged from an oil pump rotor is known. Such a variable oil pump is disclosed in Japanese Patent Laying-Open No. 2014-159761, for example.

Japanese Patent Laying-Open No. 2014-159761 discloses a hydraulic controller that controls an oil pump (variable oil pump) including a variable displacement mechanism. The oil pump, the capacity of which is controlled by the hydraulic controller, described in Japanese Patent Laying-Open No. 2014-159761 includes an adjustment ring (adjustment member) that rotatably holds a driven rotor housed in a housing from the outer peripheral side. The adjustment ring is displaced (rotated) due to hydraulic pressure, and hence the rotational center of the driven rotor with respect to the rotational center of a drive rotor is moved such that the discharge amount per rotation of the oil pump can be increased and decreased. Inside the housing, a guide pin that protrudes from the bottom of the housing engages with a guide hole (groove) formed in the adjustment ring, and the displacement (the trajectory of rotation) of the adjustment ring is defined along the movement trajectory of the guide hole that engages with the guide pin. At an initial position where the adjustment ring starts to be displaced, the arcuate inner surface of one end of the guide hole comes into circumferential surface contact with the outer surface of the guide pin such that the adjustment ring is held.

PRIOR ART

Patent Document

Patent Document 1: Japanese Patent Laying-Open No. 2014-159761

SUMMARY OF THE INVENTION

Problem to be Solved by the Invention

However, in the oil pump (variable oil pump) described in Japanese Patent Laying-Open No. 2014-159761, the arcuate inner surface of the guide hole comes into circumferential surface contact with the outer surface of the guide pin at the initial position where the adjustment ring starts to be displaced (rotate), and hence a state where the outer surface of the guide pin sticks to the inner surface of the guide hole due to oil in the guide hole is maintained. Accordingly, when a drive force is applied to the adjustment ring, the inner surface of the guide hole cannot be instantaneously separated from the outer surface of the guide pin, and there is a disadvantage that the adjustment ring (adjustment member) does not start to be smoothly displaced (rotate). Therefore, there is a problem that responsiveness in changing the oil discharge amount is deteriorated.

The present invention has been proposed in order to solve the aforementioned problem, and an object of the present invention is to provide a variable oil pump capable of improving responsiveness in changing the oil discharge amount by smoothly displacing (rotating) an adjustment member.

Means for Solving the Problem

In order to attain the aforementioned object, a variable oil pump according to an aspect of the present invention includes a pump housing, an oil pump rotor housed in the pump housing and rotationally driven, an adjustment member housed in the pump housing and that adjusts an amount of oil discharged from the oil pump rotor by being displaced due to a drive force while rotatably holding the oil pump rotor from an outer peripheral side, and a guide portion including a groove provided in the adjustment member and a pin provided on the pump housing and that engages with the groove, and the guide portion that guides relative displacement of the adjustment member with respect to the pump housing by engaging the groove and the pin with each other. In the guide portion, an inner surface of the groove and an outer surface of the pin come into line contact with each other along a direction in which the pin extends at an initial position where the adjustment member starts to be displaced.

In the variable oil pump according to this aspect of the present invention, as hereinabove described, in the guide portion, the inner surface of the groove and the outer surface of the pin come into line contact with each other along the direction in which the pin extends at the initial position where the adjustment member starts to be displaced. Thus, at the initial position, the inner surface of the groove and the outer surface of the pin come into line contact with each other along the direction in which the pin extends, and hence a small air gap is formed between the inner surface of the groove and the outer surface of the pin such that it is possible to prevent the outer surface of the pin from sticking to the inner surface of the groove due to oil (the surface tension of a very thin oil film) in the groove. Thus, when the drive force is applied to the adjustment member, the inner surface of the groove can be instantaneously separated from the outer surface of the pin, and the displacement (rotation) can start. Consequently, responsiveness in changing the oil discharge amount can be improved.

In the aforementioned variable oil pump according to this aspect, at the initial position where the adjustment member starts to be displaced, the groove and the pin preferably come into line contact with each other at two or more places.

According to this structure, by using portions where the groove and the pin come into line contact with each other at the two or more places, the adjustment member can be securely held at the initial position where the displacement (rotation) starts. Therefore, while rattling of the adjustment member at the initial position where the displacement (rotation) starts is significantly reduced or prevented, the adjustment member can be smoothly displaced from the initial position when the drive force is applied.

In the aforementioned variable oil pump according to this aspect, the outer surface of the pin is preferably circular, and a portion of the inner surface of the groove that comes into line contact with the outer surface of the pin is preferably flat.

According to this structure, the flat inner surface of the groove can easily and reliably come into line contact with the circular outer surface of the pin along the direction in which the pin extends. Also from a manufacturing standpoint, the groove including the flat inner surface that can come into line contact with the outer surface of the pin can be easily provided in the adjustment member.

In this case, the flat portion of the inner surface of the groove is preferably disposed at an end of the groove corresponding to the initial position where the adjustment member starts to be relatively displaced along the pin.

According to this structure, the adjustment member can be securely held at the initial position where the rotation starts, and hence it is possible to reliably prevent the adjustment member from rattling at the initial position. Furthermore, in a state where the adjustment member is securely held at the initial position, the adjustment member can be separated from the initial position with no difficulty while the drive force is applied.

In the aforementioned variable oil pump according to this aspect, the pin preferably includes a pair of pins provided on the pump housing, and the groove preferably includes a pair of grooves provided in the adjustment member and that come into line contact with and engage with the pins.

According to this structure, the variable oil pump includes a pair of guide portions each including the pin and the groove, and hence when in at least one of the pair of guide portions, the pin and the groove come into line contact with each other at the initial position, the adjustment member can smoothly rotate. Even when the pair of guide portions are indispensable for rotation of the adjustment member, air gaps between the outer surfaces of the pins and the inner surfaces of the grooves prevent the inner surfaces of the grooves from sticking to the outer surfaces of the pins in both the guide portions, and hence it is possible to reliably start smooth rotation of the adjustment member.

In the aforementioned variable oil pump according to this aspect, an oil reservoir is preferably formed between the outer surface of the pin and the inner surface of the groove that come into line contact with each other.

According to this structure, at the initial position where the adjustment member starts to rotate, the entire inner surface of the groove is prevented from sticking to the outer surface of the pin such that the adjustment member can smoothly rotate from the initial position, using the lubricating property of the oil in a state where the lubricating oil is retained in the oil reservoir having a larger retaining amount than that of a thin oil film.

MODES FOR CARRYING OUT THE INVENTION

An embodiment of the present invention is hereinafter described on the basis of the drawings.

Embodiment

The configuration of a variable oil pump 100 according to the embodiment of the present invention is now described with reference to FIGS. 1 to 6.

(Overall Configuration of Variable Oil Pump)

Figure 1:
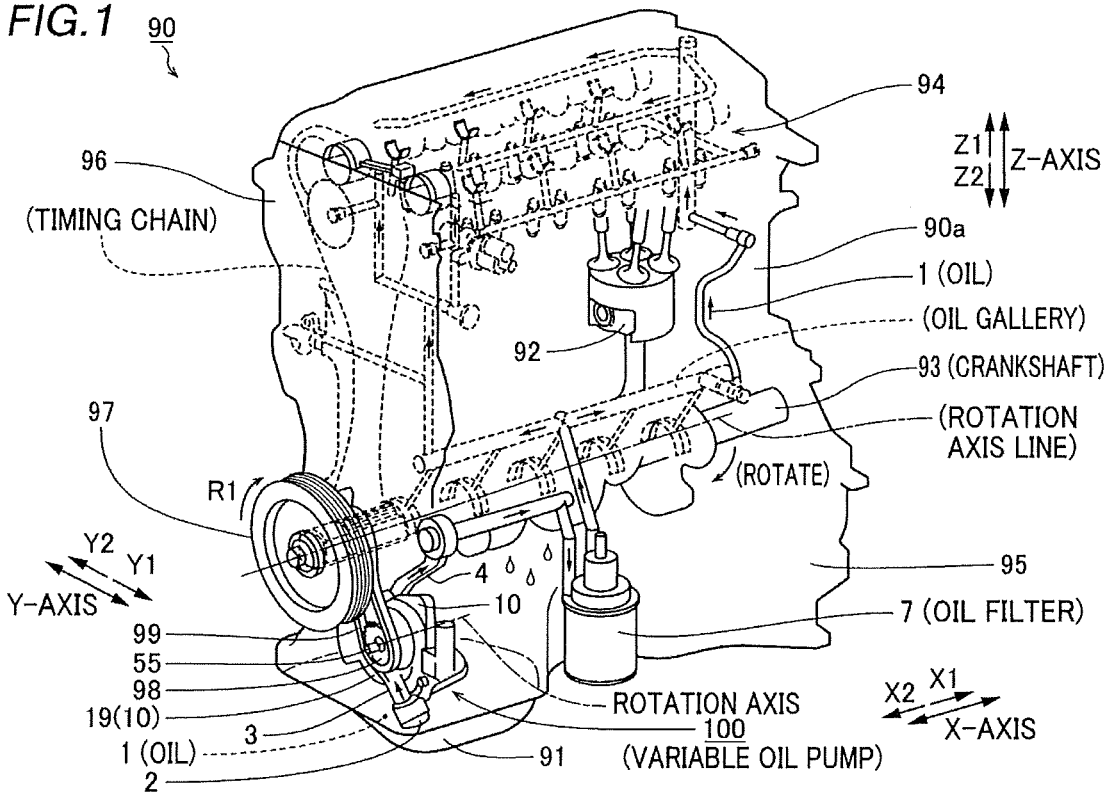
FIG. 1 A diagram showing an engine mounted with a variable oil pump according to an embodiment of the present invention.

As shown in FIG. 1, the variable oil pump 100 according to the embodiment of the present invention is mounted on an automobile (not shown) including an engine 90. The variable oil pump 100 has a function of pumping oil (engine oil) 1 in an oil pan 91 to movable portions (sliding portions) such as a plurality of pistons 92, a crankshaft 93, and a valve mechanism 94.

Figure 2:
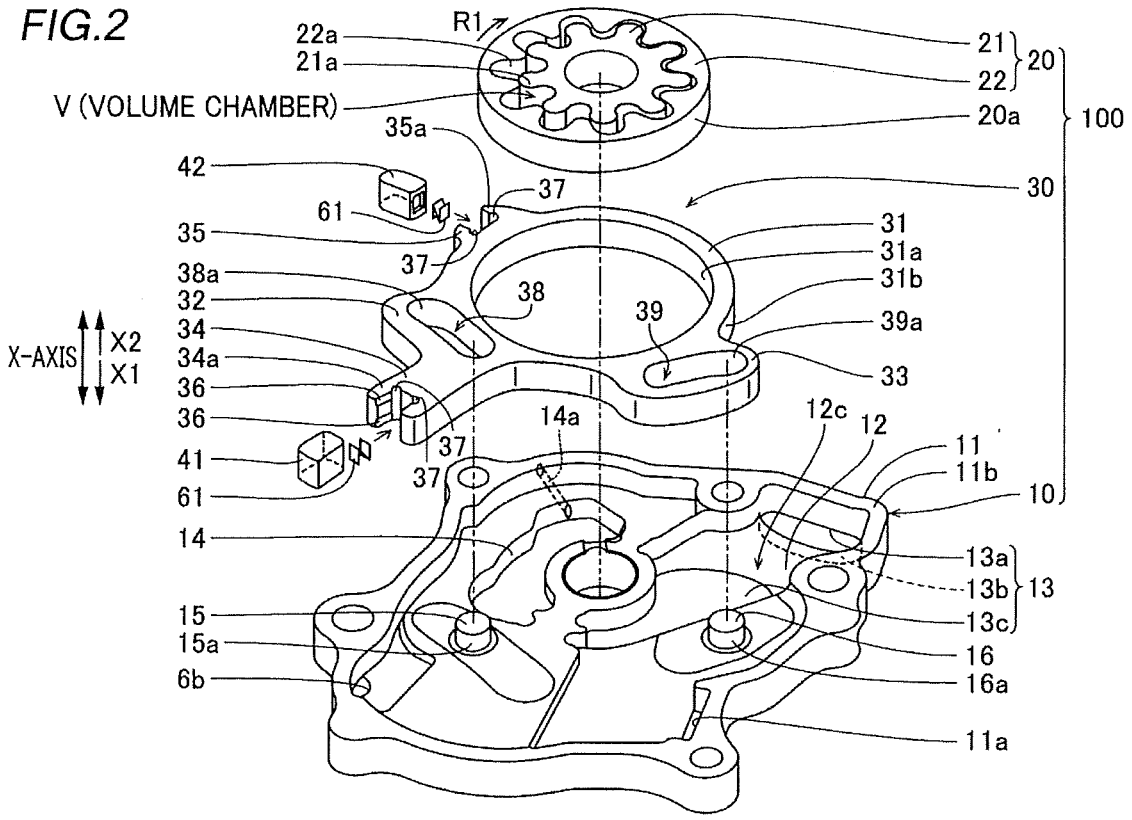
FIG. 2 An exploded perspective view showing the structure of the variable oil pump according to the embodiment of the present invention.

As shown in FIG. 2, the variable oil pump 100 includes a housing 10 (an example of a pump housing), a pump rotor (oil pump rotor) 20 rotatably provided in the housing 10, an adjustment ring 30 (an example of an adjustment member) that rotatably holds the pump rotor 20 from the outer peripheral side, a coil spring 60 (see FIG. 3) that urges the adjustment ring 30 toward its initial position, and a cover 19 (an example of a pump housing) (see FIG. 1) that covers the housing 10 in an arrow X1 direction from an X2 side. The pump rotor 20 includes an inner rotor 21 of an external gear and an outer rotor 22 of an internal gear.

Figure 3:
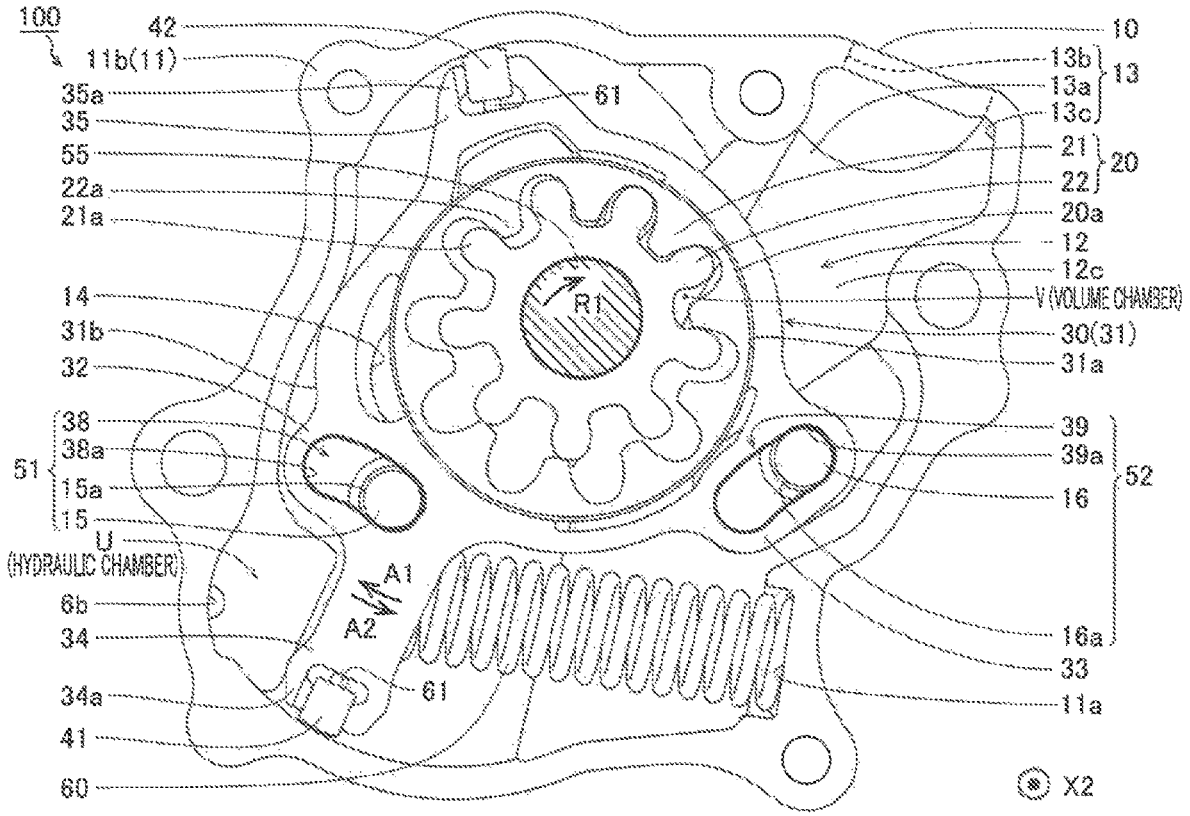
FIG. 3 A diagram showing the internal structure of the variable oil pump according to the embodiment of the present invention.

As shown in FIG. 3, the rotational center of the inner rotor 21 is decentered by a fixed amount with respect to the rotational center of the outer rotor 22. When the inner rotor 21 rotates in an arrow R1 direction (clockwise direction), the outer rotor 22 rotates with a slight delay in the same direction. At the time of rotation, in a portion where a distance between the inner rotor 21 and the outer rotor 22 is short, external teeth 21*a* of the inner rotor 21 mesh with internal teeth 22*a* of the outer rotor 22. On the other hand, in a portion where the distance is long, the number of the external teeth 21*a* of the inner rotor 21 is one less than the number of the internal teeth 22*a* of the outer rotor 22, and hence a volume chamber V is gradually formed between the inner rotor 21 and the outer rotor 22. Furthermore, the volume chamber V expands and contracts as the pump rotor 20 rotationally moves in the arrow R1 direction such that a pumping function is created in the pump rotor 20.

The external teeth 21*a* of the inner rotor 21 each have a tooth profile in which the tooth width is narrowed and the tooth length is stretched radially outward as compared with external teeth of an inner rotor in a common trochoid pump. Furthermore, the internal teeth 22*a* of the outer rotor 22 match the tooth profile of the external teeth 21*a* to be able to mesh therewith. Thus, a larger volume of the volume chamber V formed in the pump rotor 20 is ensured.

As shown in FIG. 1, the variable oil pump 100 is disposed obliquely downward (on a Z2 side) with respect to the crankshaft 93 inside a crankcase 95. In the engine 90, a vertically long chain cover (timing chain cover) 96 is fastened to a side end surface on the X2 side of an engine block 90*a* including the crankcase 95, and a region (Z2 side) of a lower end of the chain cover 96 is fastened to a side end surface of the oil pan 91 in the crankcase 95. An end of the crankshaft 93 on the X2 side is exposed to the outside (X2 side) via an oil seal (not shown) fitted into a through-hole of the chain cover 96, and a crank pulley 97 is attached to this portion.

Accordingly, the variable oil pump 100 is disposed inside the chain cover 96, and a timing chain 99 is wound around the crankshaft 93 and a sprocket 98 on the side of an input shaft 55. The drive force of the crankshaft 93 is transmitted to the input shaft 55 via the timing chain 99 and the sprocket 98 both for driving the oil pump, and the pump rotor 20 is rotated by the input shaft 55 pressed into the inner rotor 21.

(Detailed Configuration of Variable Oil Pump)

As shown in FIG. 2, the housing 10 is a concave (deep dish-shaped) casting of an aluminum alloy, and includes a circumferential wall 11 that surrounds the outer edge of the housing 10 and a bottom 12 that connects the wall 11. Furthermore, in a state where the pump rotor 20, the adjustment ring 30, and the coil spring 60 (see FIG. 3) are housed in a concave housing recess 12*c* defined by the wall 11 and the bottom 12 in a predetermined positional relationship, the cover 19 (see FIG. 1) is attached. In addition, the housing 10 is provided with a suction port 13 through which the oil 1 (see FIG. 1) is suctioned and a discharge port 14 through which the oil 1 (see FIG. 1) is discharged.

Whereas the suction port 13 is connected to a pipe 3 (see FIG. 5) connected to an oil strainer 2 via an oil passage 13*b* inside the housing 10 from an opening 13*a* opened in the bottom 12, a downstream portion 13*c* is formed in a shallow groove shape by recessing the bottom 12 according to a suction range. The discharge port 14 is formed in a shallow groove shape by recessing the bottom 12 according to a discharge range, and is connected to a discharge oil passage 4 (see FIG. 5) via an oil passage 14*a* inside the housing 10.

The housing 10 includes two pins 15 and 16 that protrude in an X-axis direction from the bottom 12. The pins 15 and 16 include outer surfaces 15*a* and 16*a* circularly formed. The pins 15 and 16 are configured to engage with guide holes 38 and 39 of the adjustment ring 30 described later, respectively. This point is described in detail later. In addition, the cover 19 (see FIG. 1) is fastened to a joint surface 11*b* (an end surface on the X2 side) of the wall 11 of the housing 10 in the arrow X1 direction from the X2 side in FIG. 2 by a fastening member (not shown).

The variable oil pump 100 includes a variable displacement mechanism to change the discharge amount (pump capacity) of the oil 1 discharged every rotation of the pump rotor 20. This variable displacement mechanism is a mechanism that displaces (rotates) the adjustment ring 30 due to the hydraulic pressure (control hydraulic pressure) of a hydraulic chamber U formed in the housing recess 12*c* of the housing 10. The relative positions of the inner rotor 21 and the outer rotor 22 with respect to the suction port 13 and the discharge port 14 are changed due to the displacement (rotation) of the adjustment ring 30, and the pump capacity is changed. The variable displacement mechanism including the adjustment ring 30 is described below in detail.

(Configuration of Variable Displacement Mechanism)

As shown in FIG. 2, the adjustment ring 30 includes a main body 31, overhangs 32 and 33, an operation portion 34, and a protrusion 35. The overhangs 32 and 33, the operation portion 34, and the protrusion 35 are integral with the main body 31. The pump rotor 20 is disposed such that its outer peripheral surface 20*a* smoothly contacts (slides with respect to) the inner peripheral surface 31*a* of the main body 31.

The main body 31 is annular, and has a function of rotatably holding the pump rotor 20 (outer rotor 22) from the outer peripheral surface 20*a* side. The outer surface 31*b* of the main body 31 overhangs outward (in an outward radial direction of rotation) such that the overhangs 32 and 33 are formed. The overhang 32 is formed with the elongated hole-shaped guide hole 38 (an example of a groove) that penetrates in a thickness direction (X-axis direction) and is gently curved. In addition, the overhang 33 is formed with the elongated hole-shaped guide hole 39 (an example of a groove) that penetrates in the thickness direction and is gently curved.

The operation portion 34 protrudes from the outer surface 31*b*, and is a portion to which an external force (the hydraulic pressure of the hydraulic chamber U or the urging force of the coil spring 60) is applied when the main body 31 rotates. A vane holding portion 34*a*, which includes a concavely recessed tip, of the operation portion 34 holds a vane 41 via a leaf spring 61. The protrusion 35 protrudes from the outer surface 31*b*, and a vane holding portion 35*a* including a concavely recessed tip holds a vane 42 via a leaf spring 61. The vanes 41 and 42 have substantially the same length as the thickness (a dimension in the X-axis direction) of the adjustment ring 30, and are made of a resin material or the like excellent in wear resistance.

As shown in FIG. 3, the coil spring 60 is fitted into a region where the inner surface 11*a* of the wall 11 faces the operation portion 34 in a state where the adjustment ring 30 is housed in the housing 10. The operation portion 34 is urged in an arrow A1 direction due to the extension force of the coil spring 60. That is, due to the pressing force of the coil spring 60 that acts on the operation portion 34, the adjustment ring 30 is urged so as to be rotated (displaced) in the clockwise direction in FIG. 1 about the input shaft 55. Thus, when the hydraulic pressure does not act on the operation portion 34, the adjustment ring 30 is held at the initial position P1 where the adjustment ring 30 starts to be displaced (rotate) in a state where the coil spring 60 is maximally extended.

In a state where the adjustment ring 30 is housed in the housing 10, the hydraulic chamber U is formed in a region surrounded by the inner surface 11*a* of the wall 11, the vanes 41 and 42, and the outer surface 31*b* (including a portion of the outer surface of the operation portion 34) of the adjustment ring 30 between the vanes 41 and 42.

In a state where the adjustment ring 30 is housed in the housing 10, the pin 15 is slidably inserted into the guide hole 38 and engages therewith, and the pin 16 is slidably inserted into the guide hole 39 and engages therewith. The pin 15 and the guide hole 38 engage with each other, and the pin 16 and the guide hole 39 engage with each other such that guide portions 51 and 52 guide relative displacement (rotation) of the adjustment ring 30 with respect to the housing 10. In other words, the guide portions 51 and 52 restrict a direction in which the adjustment ring 30 rotates to a direction in which the guide holes 38 and 39 extend (the longitudinal direction of the cross-sections of the guide holes 38 and 39).

Figure 4:
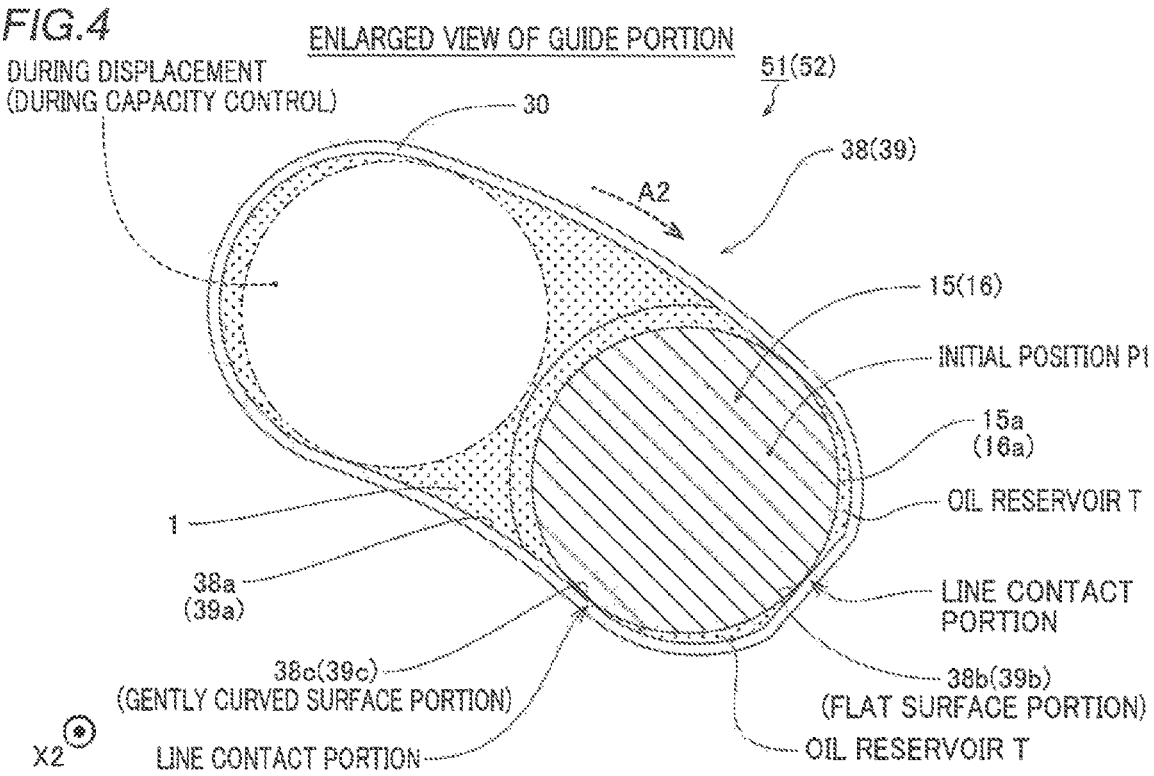
FIG. 4 An enlarged view showing a guide portion of the variable oil pump according to the embodiment of the present invention.

According to this embodiment, as shown in FIG. 4, in the guide portion 51, the inner surface 38*a* of the guide hole 38 and the outer surface 15*a* of the pin 15 come into line contact with each other along the X-axis direction in which the pin 15 extends at the initial position P1 where the adjustment ring 30 (see FIG. 3) starts to be displaced (rotate). Similarly, in the guide portion 52, the inner surface 39*a* of the guide hole 39 and the outer surface 16*a* of the pin 16 come into line contact with each other along the X-axis direction in which the pin 16 extends at the initial position P1 where the adjustment ring 30 (see FIG. 3) starts to be displaced (rotate). The guide portion 51 and the guide portion 52 have the same configuration (function), and hence the guide portion 15 continues to be described as a representative.

According to this embodiment, as shown in FIG. 4, at the initial position P1 where the adjustment ring 30 starts to be displaced, the pin 15 and the guide hole 38 come into line contact with each other at two places. In this case, the outer surface 15*a* of the pin 15 is circular, and the inner surface 38*a* of the guide hole 38 has a flat portion. Specifically, a contact portion 38*b* of the inner surface 38*a* corresponding to an end of the guide hole 38 on an A2 side that comes into line contact with the outer surface 15*a* of the pin 15 includes a flat surface. Similarly, a contact portion 39*b* of the inner surface 39*a* corresponding to an end of the guide hole 39 on the A2 side that comes into line contact with the outer surface 16*a* of the pin 16 includes a flat surface.

Therefore, at the initial position P1 where the adjustment ring 30 starts to be displaced with respect to the pin 15 (16), the adjustment ring 30 comes into line contact with the outer surface 15*a* (16*a*) of the pin 15 (16) at the two places of the contact portion 38*b* (39*b*) including the flat surface of the guide hole 38 (39) and a contact portion 38*c* (39*c*) including the gently curved portion of the inner surface 38*a* (39*a*) of the guide hole 38 (39). Thus, small oil reservoirs T are formed in a portion other than contact portions between the contact portions 38*b* and 38*c* (39*b* and 39*c*) and the outer surface 15*a* (16*a*). The oil reservoirs T each have a space volume larger than a volume where a simple thin oil film is formed.

Figure 5:
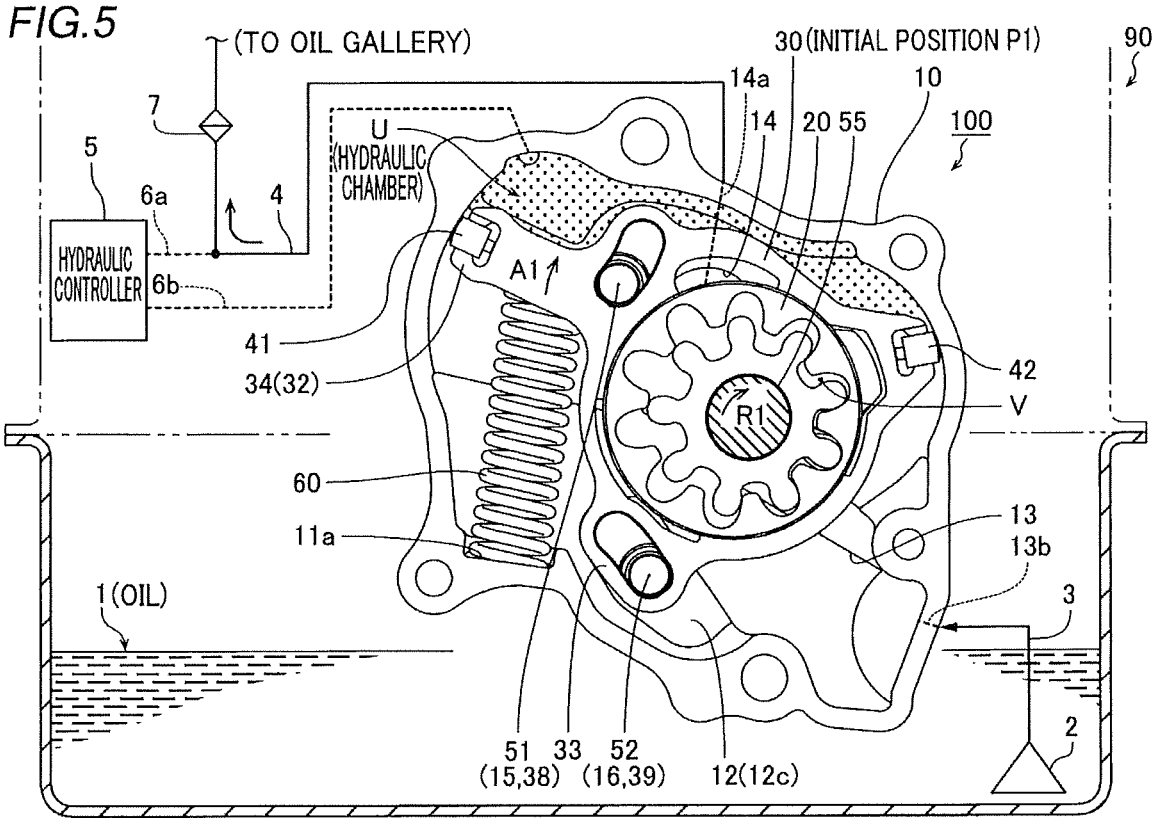
FIG. 5 A diagram showing the control state (initial position) of the variable oil pump according to the embodiment of the present invention.

As shown in FIG. 5, a hydraulic controller 5 that allows the variable displacement mechanism of the variable oil pump 100 to operate is provided in the discharge oil passage 4 of the engine 90. Specifically, the variable oil pump 100 and the hydraulic controller 5 are connected to each other by an oil passage 6*a* that branches from the discharge oil passage 4. The hydraulic controller 5 and the hydraulic chamber U in the housing 10 are connected to each other via an oil passage 6*b*. During operation of the variable oil pump 100, the hydraulic controller 5 operates based on a control signal from an ECU (not shown) mounted on the engine 90 such that the oil 1 delivered from the discharge oil passage 4 to the engine 90 (oil gallery) via an oil filter 7 (see FIG. 1) is partially drawn into the hydraulic controller 5 via the oil passage 6*a*, and then supplied to the hydraulic chamber U via the oil passage 6*b*.

Variable displacement control of the amount of the oil 1 discharged by the variable oil pump 100 is now described with reference to FIGS. 5 and 6.

(Description of Variable Displacement Control)

First, as shown in FIG. 5, the pump rotor 20 is driven in the arrow R1 direction by the input shaft 55 that rotates together with the start-up of the engine 90. At this time, the hydraulic controller 5 does not operate, and the adjustment ring 30 is held at the initial position P1 reached when the adjustment ring 30 is maximally rotated in the arrow A1 direction due to the urging force of the coil spring 60. At the initial position P1 (see FIG. 4), the inner surface 38*a* (39*a*) of the guide hole 38 (39) and the outer surface 15*a* (16*a*) of the pin 15 (16) come into line contact with each other along the direction in which the pin 15 (16) extends. Furthermore, at the initial position P1, the suction port 13 faces a negative pressure action region where the pressure of the oil 1 is reduced between the external teeth 21*a* of the inner rotor 21 and the internal teeth 22*a* of the outer rotor 22, and the discharge port 14 faces a positive pressure action region where the oil 1 is compressed between the external teeth 21*a* of the inner rotor 21 and the internal teeth 22*a* of the outer rotor 22. Therefore, the oil 1 in the oil pan 91 is suctioned into the pump rotor 20 from the suction port 13 and is discharged from the discharge port 14 to the discharge oil passage 4 via the oil passage 14*a*.

Figure 6:
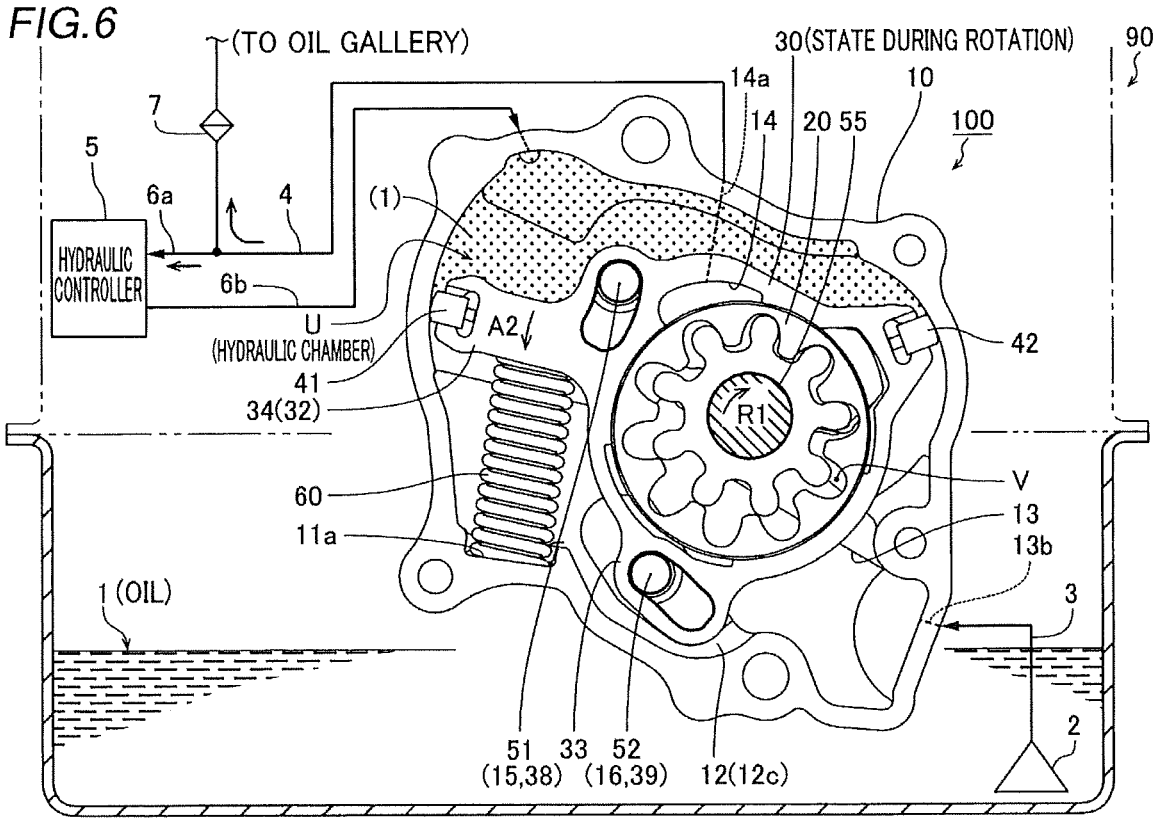
FIG. 6 A diagram showing the capacity control state of the variable oil pump according to the embodiment of the present invention.

Then, as shown in FIG. 6, the hydraulic controller 5 operates based on the control signal from the ECU (not shown) according to the rotational speed and load of the engine 90. That is, after the oil 1 from the suction port 13 is drawn into the hydraulic controller 5 via the oil passage 6*a*, the oil 1 is supplied to the hydraulic chamber U via the oil passage 6*b*. Then, the hydraulic pressure of the oil 1 supplied to the hydraulic chamber U acts on the operation portion 34 of the adjustment ring 30 such that the adjustment ring 30 starts to rotate in an arrow A2 direction against the urging force of the coil spring 60.

At this time, as shown in FIG. 4, the contact portions 38*b* and 38*c* (39*b* and 39*c*) of the inner surface 38*a* (39*a*) of the guide hole 38 (39) and the outer surface 15*a* (16*a*) of the pin 15 (16) come into line contact with each other along the X-axis direction, in which the pin 15 (16) extends, at the initial position P1, and hence the small oil reservoirs T are formed between the inner surface 38*a* (39*a*) and the outer surface 15*a* (16*a*). Therefore, the outer surface 15*a* (16*a*) of the pin 15 (16) is prevented from sticking to the inner surface 38*a* (39*a*) of the guide hole 38 (39) due to the surface tension of the very thin oil film of the oil 1 in the guide hole 38 (39). Thus, when the hydraulic pressure of the oil 1 supplied to the hydraulic chamber U is applied to the operation portion 34 of the adjustment ring 30, the inner surface 38*a* (39*a*) of the guide hole 38 (39) is instantaneously separated from the pin 15 (16), and the rotation in the arrow A2 direction starts.

As shown in FIG. 6, together with the rotation of the adjustment ring 30 in the arrow A2 direction, the outer rotor 22 of the pump rotor 20 revolves in the arrow A2 direction while maintaining a predetermined amount of eccentricity with respect to the rotational center of the inner rotor 21 in a state where the internal teeth 22*a* mesh with the external teeth 21*a* of the inner rotor 21. Thus, the positive pressure action region and the negative pressure action region are moved about the rotational center of the inner rotor 21, and hence the negative pressure that acts on the suction port 13 from the negative pressure action region is reduced, and the positive pressure that acts on the discharge port 14 from the positive pressure action region is also reduced. Consequently, the amount (a supply to the engine 90) of the oil 1 discharged from the pump rotor 20 is reduced.

The ECU controls the operation of the hydraulic controller 5 in detail such that the hydraulic pressure (the urging force for urging the operation portion 34 in the arrow A2 direction) of the oil 1 supplied to the hydraulic chamber U is adjusted. Thus, the rotational position of the adjustment ring 30 is precisely adjusted according to the balance relationship between the hydraulic pressure of the hydraulic chamber U with respect to the operation portion 34 and the urging force (the urging force for urging the operation portion 34 in the arrow A1 direction) of the coil spring 60 with respect to the operation portion 34. In addition, the rotational position of the adjustment ring 30 is adjusted such that the amount of the oil 1 discharged by the variable oil pump 100 is controlled in detail. The variable oil pump 100 according to this embodiment is configured as described above.

Effects of Embodiment

According to this embodiment, the following effects can be obtained.

According to this embodiment, as hereinabove described, in the guide portion 51 (52), the contact portions 38*b* and 38*c* (39*b* and 39*c*) of the inner surface 38*a* (39*a*) of the guide hole 38 (39) and the outer surface 15*a* (16*a*) of the pin 15 (16) come into line contact with each other along the X-axis direction in which the pin 15 (16) extends at the initial position P1 where the adjustment ring 30 starts to rotate. Thus, at the initial position P1, the contact portions 38*b* and 38*c* (39*b* and 39*c*) of the inner surface 38*a* (39*a*) of the guide hole 38 (39) and the outer surface 15*a* (16*a*) of the pin 15 (16) come into line contact with each other along the X-axis direction in which the pin 15 (16) extends, and hence the small oil reservoirs T are formed between the inner surface 38*a* (39*a*) and the outer surface 15*a* (16*a*) such that it is possible to prevent the outer surface 15*a* (16*a*) of the pin 15 (16) from sticking to the inner surface 38*a* (39*a*) of the guide hole 38 (39) due to the oil 1 (the surface tension of the very thin oil film) in the guide hole 38 (39). Thus, when the hydraulic pressure of the oil 1 supplied to the hydraulic chamber U is applied to the operation portion 34 of the adjustment ring 30, the inner surface 38*a* (39*a*) of the guide hole 38 (39) can be instantaneously separated from the outer surface 15*a* (16*a*) of the pin 15 (16), and the rotation in the arrow A2 direction can start. Consequently, responsiveness at the time of variable control of the oil discharge amount can be improved.

According to this embodiment, at the initial position P1, the inner surface 38*a* (39*a*) of the guide hole 38 (39) and the outer surface 15*a* (16*a*) of the pin 15 (16) come into line contact with each other at the two places (the two places of the contact portions 38*b* and 38*c* (39*b* and 39*c*) of the guide holes 38 (39) with respect to the pin 15 (16)). Thus, by using the contact portions 38*b* and 38*c* (39*b* and 39*c*) where the guide hole 38 (39) and the pin 15 (16) come into line contact with each other at the two places, the adjustment ring 30 can be securely held at the initial position P1 where the rotation starts. Therefore, while rattling of the adjustment ring 30 at the initial position P1 where the rotation starts is significantly reduced or prevented, the adjustment ring 30 can smoothly rotate in the arrow A2 direction from the initial position P1 when the hydraulic pressure (drive force) of the oil 1 supplied to the hydraulic chamber U is applied to the operation portion 34.

According to this embodiment, the outer surface 15*a* (16*a*) of the pin 15 (16) is circular, and the contact portion 38*b* (39*b*) of the inner surface 38*a* (39*a*) of the guide hole 38 (39) that comes into line contact with the outer surface 15*a* of the pin 15 (16) includes the flat surface. Thus, the contact portion 38*b* (39*b*), including the flat surface of the inner surface 38*a* (39*a*), of the guide hole 38 (39) can easily and reliably come into line contact with the circular outer surface 15*a* (16*a*) of the pin 15 (16) along the X-axis direction in which the pin 15 (16) extends. Also from a manufacturing standpoint, the contact portion 38*b* (39*b*) including the flat surface that can come into line contact with the outer surface 15*a* (16*a*) of the pin 15 (16) can be easily provided in the guide hole 38 (39) of the adjustment ring 30.

According to this embodiment, the contact portion 38*b* (39*b*) of the guide hole 38 (39) including the flat surface is disposed at the end of the guide hole 38 (39) on the A2 side corresponding to the initial position P1 where the adjustment ring 30 starts to relatively move along the pin 15 (16). Thus, the adjustment ring 30 can be securely held at the initial position P1 where the rotation starts, and hence it is possible to reliably prevent the adjustment ring 30 from rattling at the initial position P1. Furthermore, in a state where the adjustment ring 30 is securely held at the initial position P1, the adjustment ring 30 can be separated in the arrow A1 direction from the initial position P1 with no difficulty while the hydraulic pressure of the oil 1 supplied to the hydraulic chamber U is applied.

According to this embodiment, a pair of pins 15 and 16 are provided on the housing 10, and a pair of guide holes 38 and 39 that come into line contact with and engage with the pins 15 and 16 are provided in the adjustment ring 30. Thus, the variable oil pump 100 includes the guide portion 51 including the pin 15 and the guide hole 38 and the guide portion 52 including the pin 16 and the guide hole 39, and hence when in at least one of the guide portions 51 and 52, the pin (15 or 16) and the guide hole (38 or 39) come into line contact with each other at the initial position P1, the adjustment ring 30 can smoothly rotate accordingly. Even when the pair of guide portions 51 and 52 are indispensable for rotation of the adjustment ring 30, portions of the oil reservoirs T (see FIG. 4) prevent the inner surfaces 38*a* and 39*a* of the guide holes 38 and 39 from sticking to the outer surfaces 15*a* and 16*a* of the pins 15 and 16 in both the guide portions 51 and 52, and hence it is possible to reliably start smooth rotation of the adjustment ring 30.

According to this embodiment, the oil reservoirs T are formed in the portions surrounded by the outer surface 15*a* (16*a*) of the pin 15 (16) and the contact portion 38*b* (39*b*) and the contact portion 38*c* (39*c*) of the guide hole 38 (39) that come into line contact with each other at the two places. Thus, at the initial position P1 where the adjustment ring 30 starts to rotate, the entire inner surface 38*a* (39*a*) of the guide hole 38 (39) is prevented from sticking to the outer surface 15*a* (16*a*) of the pin 15 (16) such that the adjustment ring 30 can smoothly rotate in the arrow A2 direction from the initial position P1, using the lubricating property of the oil 1 in a state where the lubricating oil 1 is retained in the oil reservoirs T having a larger retaining amount than that of a thin oil film.

[Modifications]

The embodiment disclosed this time must be considered as illustrative in all points and not restrictive. The range of the present invention is shown not by the above description of the embodiment but by the scope of claims for patent, and all modifications within the meaning and range equivalent to the scope of claims for patent are further included.

Figure 7:
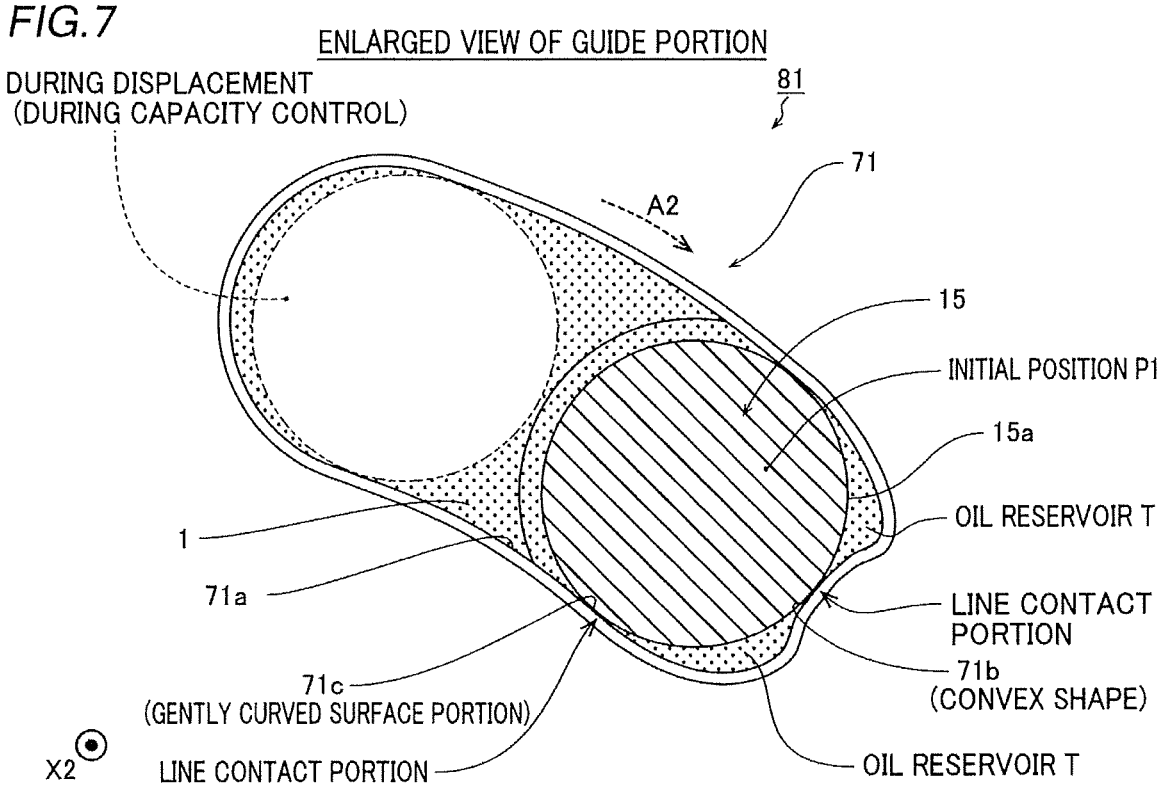
FIG. 7 An enlarged view showing a guide portion of a variable oil pump according to a first modification of the present invention.

For example, while the contact portion 38*b* (39*b*) of the guide hole 38 (39) that comes into line contact with the circular outer surface 15*a* (16*a*) of the pin 15 (16) includes the flat surface in the aforementioned embodiment, the present invention is not restricted to this. For example, as a guide portion 81 according to a first modification of the present invention shown in FIG. 7, a tip 71*b* on the side of an initial position P1 of the inner surface 71*a* of a guide hole 71 may protrude inward to come into line contact with the outer surface 15*a* of a pin 15. Also in this case, it is possible to form small oil reservoirs T in portions other than contact portions between the tip 71*b* and a contact portion 71*c* including a gently curved surface of the guide hole 71 and the outer surface 15*a* of the pin 15. Furthermore, the configuration of the guide portion 81 including the pin 15 and the guide hole 71 is also applicable to a guide portion including a pin 16 (see FIG. 3). Even with the configuration as in the first modification, the oil reservoirs T are formed such that it is possible to prevent the outer surface 15*a* of the pin 15 from sticking to the inner surface 71*a* of the guide hole 71 due to oil 1 in the guide hole 71.

Figure 8:
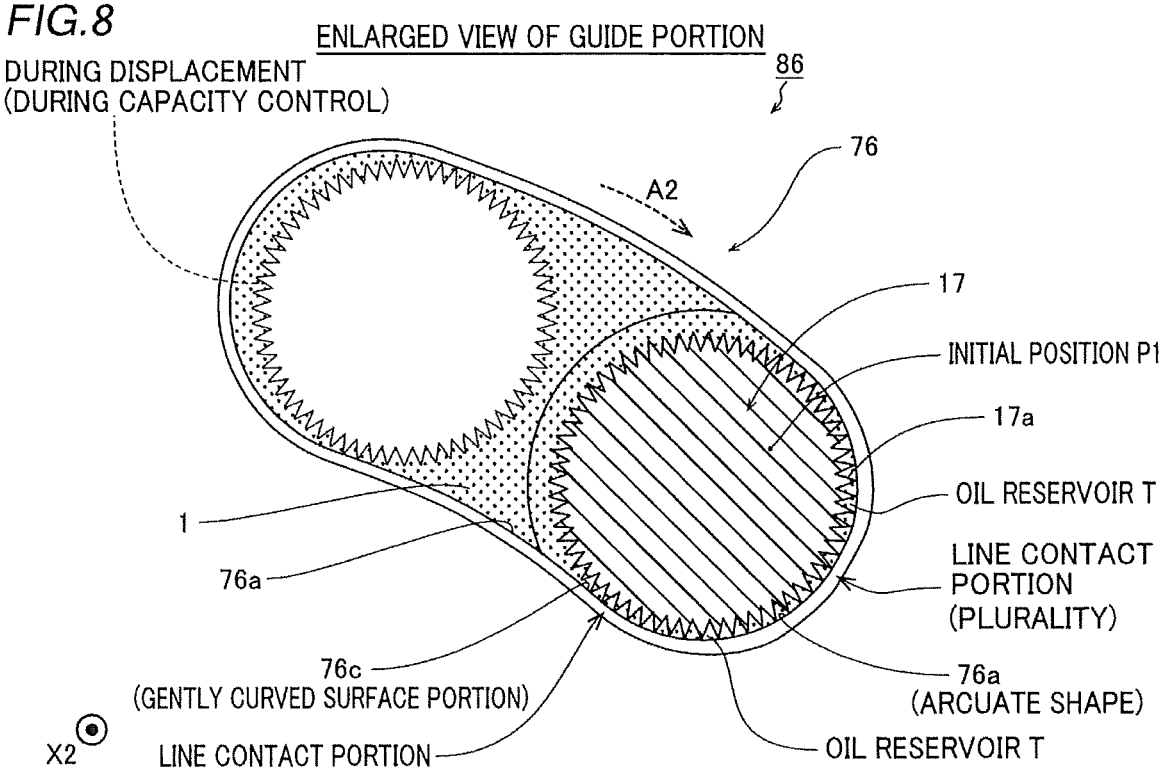
FIG. 8 An enlarged view showing a guide portion of a variable oil pump according to a second modification of the present invention.

While the inner surface of the guide hole 38 (71) is shaped to make line contact with the outer surface 15*a* of the pin 15 in each of the aforementioned embodiment and first modification, the present invention is not restricted to this. For example, as a guide portion 86 according to a second modification of the present invention shown in FIG. 8, the outer surface 17*a* of a pin 17 may have a concavo-convex (undulate) shape, and may come into line contact with the inner surface 76*a* of a guide hole 76. In this case, the inner surface 76*a* of the guide hole 76 on the side of an initial position P1 has a common arcuate shape. Also in this case, it is possible to form small oil reservoirs T in portions other than contact portions between a contact portion 76*c* including the inner surface 76*a* and a gently curved surface and the outer surface 17*a* of the pin 17. Furthermore, the configuration of the guide portion 86 including the pin 17 and the guide hole 76 is also applicable to a guide portion including a pin 16 (see FIG. 3). Even with the configuration as in the second modification, the oil reservoirs T are formed such that it is possible to prevent the outer surface 17*a* of the pin 17 from sticking to the inner surface 76*a* of the guide hole 76 due to oil 1 in the guide hole 76.

While the pin 17 includes the concavo-convex (undulate) outer surface 17*a* in the aforementioned second modification, the present invention is not restricted to this. For example, the pin may include an outer surface having a polygonal shape such as a regular dodecagonal shape or a regular octadecagonal shape. At the initial position P1 where the adjustment ring 30 starts to be displaced, the pin including the outer surface having a polygonal shape may come into line contact with the inner surface 76*a* of the guide hole 76 (groove) having a common arcuate shape.

While the present invention is applied to the variable oil pump 100 that supplies the oil 1 to the engine 90 in the aforementioned embodiment, the present invention is not restricted to this. For example, the present invention may be applied to an oil pump that supplies AT fluid to an automatic transmission (AT) that automatically switches a transmission gear ratio according to the rotational speed of an internal combustion engine. Alternatively, the present invention may be applied to an oil pump that supplies lubricating oil to a sliding portion in a continuously variable transmission (CVT) that can continuously and steplessly change a transmission gear ratio unlike the aforementioned AT (multistage transmission), or an oil pump that supplies power steering oil to a power steering that drives a steering.

While at the initial position P1, the inner surface 38*a* of the guide hole 38 and the outer surface 15*a* of the pin 15 come into line contact with each other at the two places in the aforementioned embodiment, the present invention is not restricted to this. That is, line contact may be made at three or four places.

While the variable oil pump 100 is mounted on the automobile including the engine 90 in the aforementioned embodiment, the present invention is not restricted to this. The present invention may be applied to a variable oil pump for an internal combustion engine mounted on equipment other than a vehicle (automobile). As the internal combustion engine, a gasoline engine, a diesel engine, a gas engine, etc. can be applied.

While the pump rotor 20 having a tooth profile in which the tooth width is narrowed and the tooth length is stretched radially outward as compared with external teeth of an inner rotor and internal teeth of an outer rotor in a common trochoid pump is applied in the aforementioned embodiment, the present invention is not restricted to this. That is, the present invention may be applied to a variable oil pump including an internal gear pump rotor in which the tooth profile of each of external teeth 21*a* and internal teeth 22*a* includes a trochoid curve or a cycloid curve.

DESCRIPTION OF REFERENCE NUMERALS

10: housing (pump housing)
19: cover (pump housing)
15, 16, 17: pin
15*a*, 16*a*, 17*a*: outer surface
20: pump rotor (oil pump rotor)
30: adjustment ring (adjustment member)
38, 39, 71, 76: guide hole (groove)
38*a*, 39*a*, 71*a*, 76*a*: inner surface
38*b*, 38*c*, 39*b*, 39*c*, 71*b*, 71*c*, 76*c*: contact portion
51, 52, 81, 86: guide portion
100: variable oil pump
P1: initial position
T: oil reservoir

The invention claimed is:

1. A variable oil pump comprising:

a pump housing;

an oil pump rotor housed in the pump housing and rotationally driven;

an adjustment member housed in the pump housing and that adjusts an amount of oil discharged from the oil pump rotor by being displaced due to a drive force while rotatably holding the oil pump rotor from an outer peripheral side; and a guide portion including a groove provided in the adjustment member and a pin provided on the pump housing and that engages with the groove, and the guide portion that guides relative displacement of the adjustment member with respect to the pump housing by engaging the groove and the pin with each other, the guide portion in which an inner surface of the groove and an outer surface of the pin come into line contact with each other along a direction in which the pin extends at an initial position where the adjustment member starts to be displaced, wherein the outer surface of the pin is circular, and a portion of the inner surface of the groove that comes into line contact with the outer surface of the pin is flat, and when the flat portion is in contact with the pin, the pin is in contact with first and second other portions of the inner surface of the groove, with a first oil reservoir being defined between the flat portion and the first other portion and a second oil reservoir being defined between the flat portion and the second other portion.

2. The variable oil pump according to claim 1, wherein at the initial position where the adjustment member starts to be displaced, the groove and the pin come into line contact with each other at two or more places.

3. The variable oil pump according to claim 1, wherein the pin is one of a pair of pins provided on the pump housing, and the groove is one of a pair of grooves provided in the adjustment member and that come into line contact with and engage with the pins.

4. The variable oil pump according to claim 1, wherein an oil reservoir is formed between the outer surface of the pin and the inner surface of the groove that come into line contact with each other.

* * * * *